United States Patent [19]

Baugh

[11] Patent Number: 4,811,558

[45] Date of Patent: Mar. 14, 1989

[54] SYSTEM AND METHOD FOR PROVIDING COMPRESSED GAS

[76] Inventor: Benton F. Baugh, P. O. Box 42888, Houston, Tex. 77042

[21] Appl. No.: 310,900

[22] Filed: Oct. 13, 1981

[51] Int. Cl.[4] ..... F04B 23/06; F01N 5/00

[52] U.S. Cl. ..... 60/281; 417/267; 417/404

[58] Field of Search ..... 417/267, 404, 403, 254, 417/364; 60/613, 614, 281, 315, 39.41

[56] References Cited

U.S. PATENT DOCUMENTS

| | | | |
|---|---|---|---|
| 671,236 | 4/1901 | Renault | 60/281 |
| 956,058 | 4/1910 | Elten | 166/303 |
| 1,724,934 | 8/1929 | Hoppler | 417/267 X |
| 2,175,463 | 10/1939 | Haring | 60/281 |
| 2,392,711 | 4/1944 | Willenborg | 60/281 X |
| 2,966,036 | 12/1960 | Stowens | 60/281 X |
| 3,164,325 | 1/1965 | Veum | 417/404 X |
| 3,232,885 | 2/1966 | Henke | 60/301 X |
| 3,500,635 | 3/1970 | Roper | 60/281 |
| 3,939,656 | 2/1976 | Goldfein | 60/381 |
| 4,087,209 | 5/1978 | Máhig et al. | 417/268 |
| 4,111,609 | 9/1978 | Braun | 417/267 X |

FOREIGN PATENT DOCUMENTS

| | | | |
|---|---|---|---|
| 559180 | 4/1931 | Fed. Rep. of Germany | 60/281 |

*Primary Examiner*—Randolph A. Reese
*Assistant Examiner*—Peter M. Cuomo

[57] ABSTRACT

The invention comprises a system and method for providing compressed gas by extracting compressed gas directly from the combustion chamber of an internal combustion engine. The gas may be further compressed using an improved compressor, which in turn may be ultimately powered by the engine from which the gas is extracted. The compressor is preferably an axial drive, hydraulic compressor, with the engine being used to drive a pump which in turn provides the direct hydraulic driving force for the compressor.

41 Claims, 3 Drawing Sheets

SYSTEM AND METHOD FOR PROVIDING COMPRESSED GAS

BACKGROUND OF THE INVENTION

The invention pertains generally to a means for providing compressed gas. Such gas is required in the context of a number of different types of processes and operations, for example for various oil well service operations. For many such operations, the gas should be substantially inert. At present, such gas is often obtained from liquified nitrogen. However, transportation of liquified nitrogen can be a problem in certain geographical areas.

In the past, it has also been known that inert gases can be obtained from the exhaust from various types of engines. For example, U.S. Pat. Nos. 3,000,707, 3,522,846, 3,833,059 and 3,232,885 all generally pertain to such methods. However, the conventional practice has been to obtain such gas from the exhaust output of the engine, i.e. at atmospheric pressure, and then recompress it to the required pressure for its intended use. This general method requires compressors which are not only expensive per se, but are also expensive to operate.

SUMMARY OF THE INVENTION

In accord with the system and method of the present invention, exhaust gas is extracted directly from the cylinder or other combustion chamber of the engine, subsequent to firing in said chamber, so that the gas, as extracted, is already compressed. Although this detracts somewhat from the power produced by the engine itself, the present inventor has found that the savings in terms of the cost of a compressor and its operation more than make up for this small power loss.

In many instances, the gas as extracted from the combustion chamber of the engine must be further compressed for its intended use. However, it has been found that a large portion of the expense of conventional compressors is tied to the need for the capability of compressing gas from atmospheric or zero pressure to a pressure in the general range of 500 psi. By utilizing a typical diesel engine in accord with the principles of the present invention, a supply of gas can be obtained directly from the engine at a pressure of about 500–750 psi. Then, a much smaller and less expensive compressor can be employed to further compress the gas to, for example, 5,000–10,000 psi, and in addition, such compressor will require much less horsepower to operate. For example, compressing a gas from 0 psi to 600 psi requires approximately twice as much power as the further compressing of the gas from 600 psi to 5,000 psi.

The present invention not only permits a reduction in the size and operating expense of the compressor, but also a change in the very nature of the compressor which results in even further practical advantages. More specifically, while conventional compressors are of a fast moving, rotary drive type, the system and method of the present invention permit the use of a relatively slow moving, axial drive, hydraulic compressor and the present invention further encompasses such a compressor per se. The ultimate driving force for such compressor is provided by a pump or the like for propelling the hydraulic driving fluid. In accord with the present system and method, that pump can in turn be driven by the engine from which the gas is being extracted.

Another advantage of the present invention is that the pressure of gas which has been extracted from the combustion chamber of the engine can itself be used to regulate the timing of additional such gas extraction, so that gas is extracted only subsequent to firing within the combustion chamber, and not during the recharging and/or compression strokes. The outlet for the compressed gas from the combustion chamber is provided with a check valve which permits gas to discharge from the combustion chamber, but does not permit reverse flow. A suitable gas collection vessel is provided downstream of the check valve but upstream of the aforementioned compressor. By maintaining a suitable pressure within such vessel, as by a regulator valve or the like, a back pressure is maintained on the check valve, and can be chosen so as to permit discharge of exhaust gas from the combustion chamber only when the pressure within that chamber is sufficiently high, e.g. just after firing.

It is a principal object of the present invention to provide an improved system and method for providing compressed gas.

Another object of the invention is to provide such a system and method wherein compressed gas is extracted directly from the combustion chamber of an internal combustion engine.

Still another object of the present invention is to provide such a system and method wherein the pressure of the gas so extracted is utilized to regulate the timing of further gas discharge from the combustion chamber.

Yet a further object of the present invention is to provide an improved compressor.

Yet another object of the present invention is to provide such a system and method utilizing an improved compressor, driven by said internal combustion engine, to further compress the gas so extracted from said engine.

Still other objects, features, and advantages of the present invention will be made apparent by the following detailed description of the preferred embodiments, the drawings, and the claims.

DETAILED DESCRIPTION OF THE DRAWING

Figure 1:
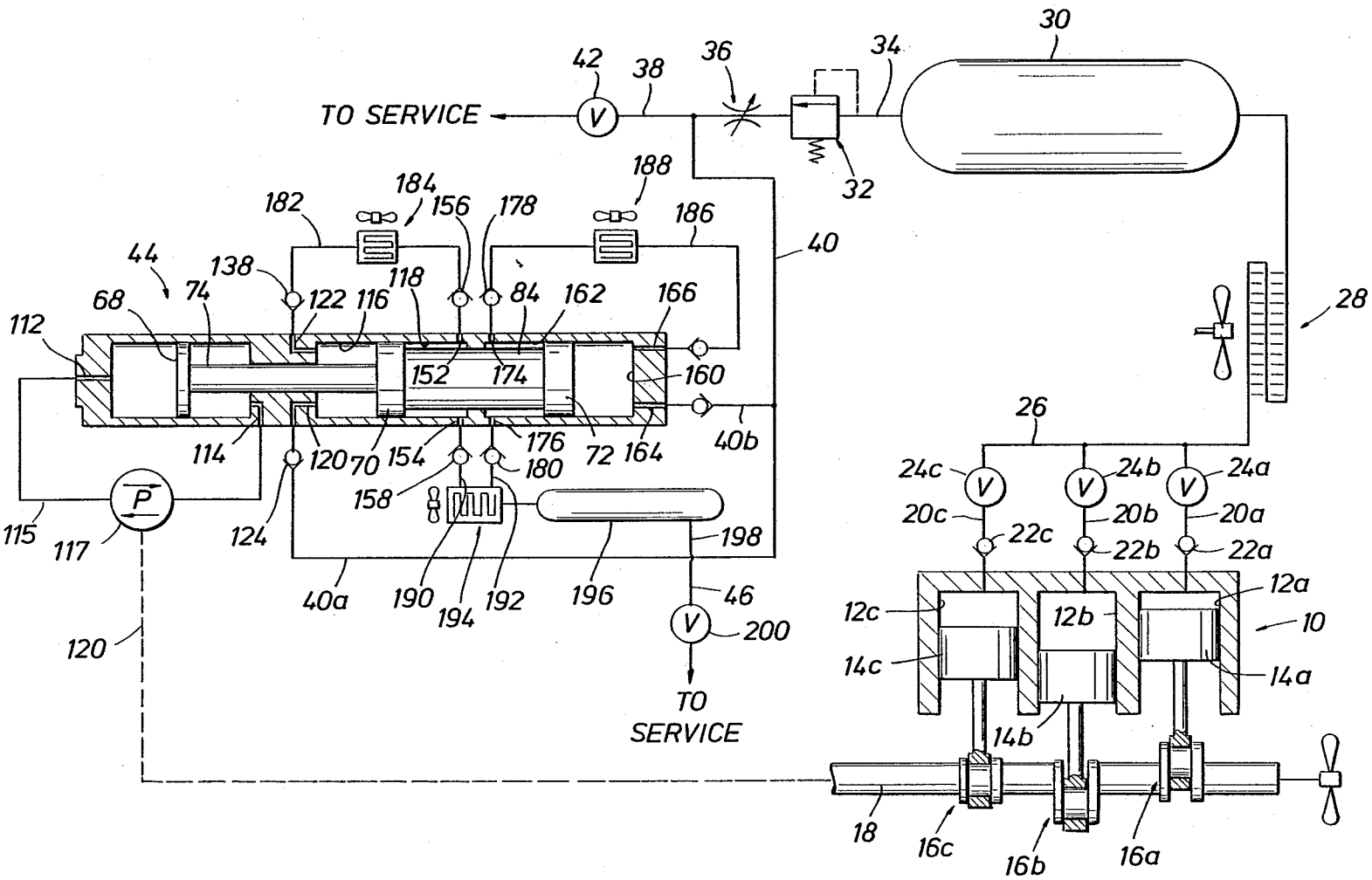
FIG. 1 is a diagram of a system according to the present invention.

Referring first to FIG. 1, there is shown a system in accord with the present invention. The system includes a diesel engine 10. While a diesel engine is preferred, due to the high pressure of the gas which it produces, it should be understood that the present invention can be applied to any type of internal combustion engine. Engine 10 has been illustrated in a simplified form showing three cylinders **12*a*, 12*b*, and 12*c*, each containing a respective piston 14*a*, 14*b*, or 14*c*. The pistons are connected by respective crank assemblies 16*a*, 16*b*, and 16*c*, in the manner well known in the art, so as to drive a shaft 18**.

Each of these cylinders 12*a*, 12*b*, and 12*c* has communicated therewith, through its cylinder head, a respective outlet line, 20*a*, 20*b*, or 20*c*. These outlet lines communicate with a common gas collection line 26. In each outlet line 20*a*, 20*b*, and 20*c*, there is a respective check valve, 22*a*, 22*b*, or 22*c*, the check valves permitting flow of gas outwardly from the cylinders, but not permitting reverse flow of gas into the cylinders. Downstream of its respective check valve, each outlet line 20*a*, 20*b*, and 20*c* also contains a second valve 24*a*, 24*b*, or 24*c* for completely shutting off the outlet line when desired. Line 26 contains a cooler 28 for lowering the temperature of the gas extracted from engine 10. From cooler 28, line 26 passes into a receiving vessel 30 where the gas is held under pressure.

Vessel 30 has an outlet line 34, in which is connected a conventional pressure regulator 32. Regulator 32 maintains a desired pressure within vessel 30, and the connected lines 26, 20*a*, 20*b*, and 20*c*. If the pressure within vessel 30 and the associated lines upstream thereof is below the chosen value, regulator 32 will prevent discharge of gas through outlet line 34 until the pressure within vessel 30 reaches the desired value. On the other hand, if the pressure within vessel 30 begins to exceed that value, regulator 32 will permit discharge of some gas until the desired pressure value is obtained. In this manner, a relatively constant back pressure, which may be on the order of 500 psi to 750 psi, is maintained on check valves 22*a*, 22*b*, and 22*c*. More specifically, such back pressure value is chosen so that, during the charging and compression strokes of pistons 14*a*, 14*b*, and 14*c*, valves 22*a*, 22*b*, and 22*c* will remain closed, but in the presence of the elevated pressure which exists after firing within cylinders 12*a*, 12*b*, and 12*c*, valves 22*a*, 22*b*, and 22*c* will open, thereby extracting compressed exhaust gas from the cylinder heads and passing it into lines 26 and vessel 30. It can be seen that the very pressure of the gas so extracted is not only used to regulate the timing of gas discharge with respect to the various strokes of a given piston and cylinder assembly, but also to time such discharge from the various cylinders, even though they fire at different points in time, without the use of expensive or complex timing mechanisms.

Outlet line 34 also contains an adjustable choke 36. Choke 36 is used to control the volume of gas delivered to either of two conduits 38 and 40 communicating with the downstream end of outlet line 34. Conduit 38 contains a valve 42 which may be opened to pass compressed gas through line 38. Line 38 would lead directly to a service site which requires only a relatively low pressure gas, less than or equal to the pressure of gas as it is recovered from engine 10. The gas so delivered, being exhaust gas, is substantially inert. Line 40 leads to a compressor, generally indicated at 44, whereby the gas can be further compressed and then delivered by conduit 46, to a service site with relatively high pressure gas requirements.

Figure 2A:
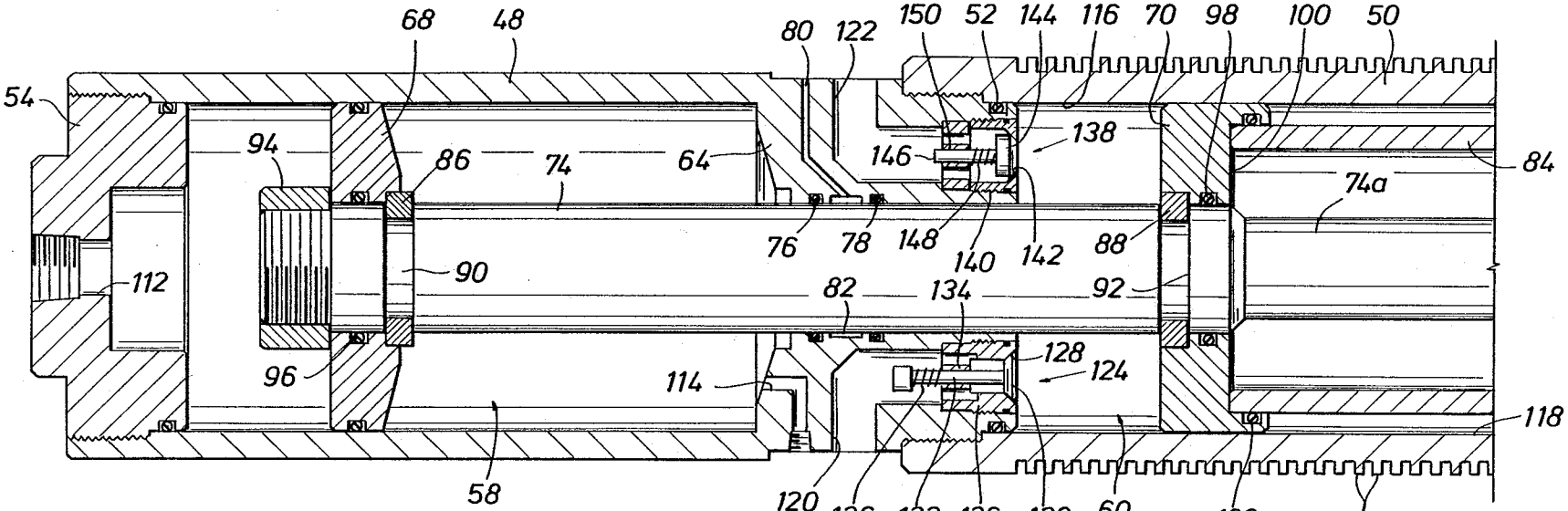
FIGS. 2A and 2B are longitudinal cross-sectional views of the left and right hand ends, respectively, of an improved compressor according to the present invention.
Figure 2B:
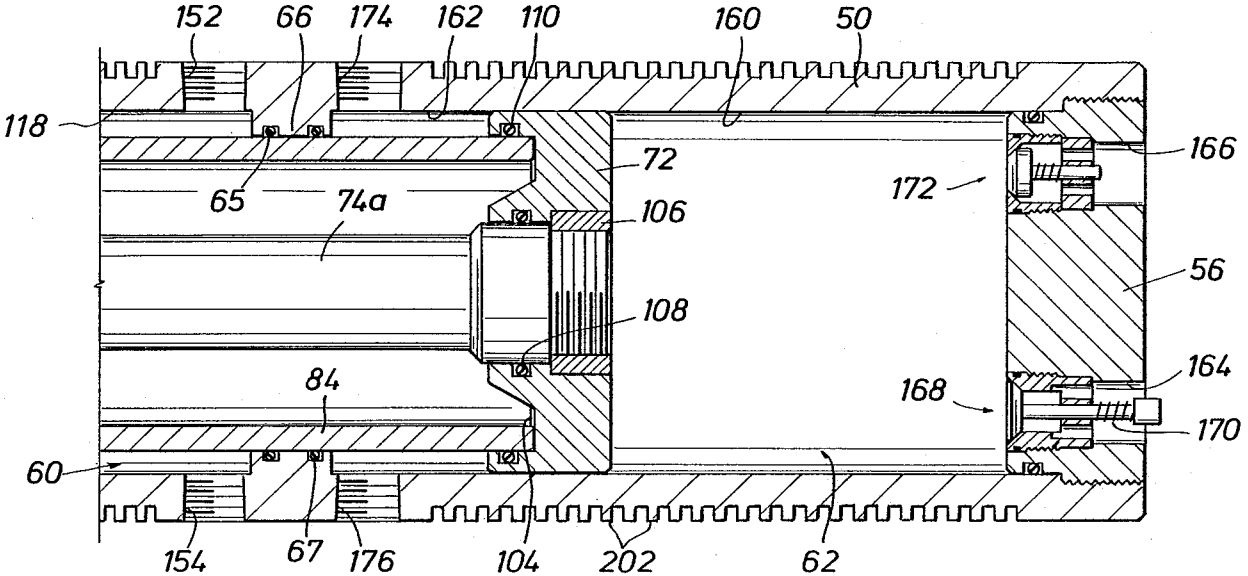

Referring now to FIGS. 2A and 2B, in conjunction with FIG. 1, compressor 44 will be described in greater detail. The compressor 44 comprises a housing, including a pair of tubular housing members 48 and 50 threadedly connected in end-to-end relation, and sealed with respect to each other by an o-ring 52. The housing further includes an end wall member 54 threaded into the outer end of tubular member 48, and an end wall member 56 threaded into the outer end of tubular member 50. The housing thus formed defines three cylinders 58, 60, and 62, which are arranged coaxially with one another. Tubular housing member 48 has formed thereon an annular partition wall 64 which extends radially inwardly into the housing between cylinders 58 and 60. A second annular partition wall 66 is formed on and extends radially inwardly from tubular housing member 50 between cylinders 60 and 62. Wall 66 carries o-ring seals 65 and 67 on its inner diameter.

Each of the three cylinders 58, 60 and 62 contains a respective piston, 68, 70 or 72. Pistons 68 and 70 are interconnected for joint movement by a piston rod 74 which is slideably received in the central opening of partition wall 64 and sealed with respect thereto by o-rings 76 and 78. A passageway 80 extends generally radially through partition wall 64 to an annular groove 82 therein, to serve as a safety vent for preventing contamination of the oil in cylinder 58.

Piston 72 is likewise connected to pistons 70 and 68 for joint movement therewith by an extension 74*a* of piston rod 74 and by a sleeve 84. More specifically, after piston rod 74 has been emplaced in the opening in partition wall 64, split rings 86 and 88 are emplaced in respective annular grooves 90 and 92 in piston rod 74. Piston 68 is emplaced on one end of piston rod 74, in abuttment with ring 86, and held in place by a nut 94 threaded to the protruding outer end of piston rod 74. Piston 68 is sealed with respect to piston rod 74 by o-ring 96. Piston 70 is emplaced over the other end of piston rod 74, in abutment with ring 88 and sealed with respect to the piston rod by an o-ring 98. Sleeve 84 is placed over the piston rod extension 74*a*, one end of sleeve 84 fitting into an axial recess 100 in piston 70. Piston 70 is sealed with respect to sleeve 84 by o-ring 102. Finally, piston 72 is emplaced over the outer end of piston rod extension 74*a* so that the adjacent end of sleeve 84 fits into and abuts an axial recess 104 in piston 72. A nut 106 is then threaded onto the end of piston rod extension 74*a* to retain piston 72 in place, and via sleeve 84, also retains piston 70 in place. Piston 72 is sealed with respect to piston rod extension 74*a* and sleeve 84 by o-rings 108 and 110 respectively.

Cylinder 58, which contains piston 68, has an access port 112 through end wall 54. Another access port 114 communicates with cylinder 58 on the opposite side of port 112 through partition wall 64. As shown in FIG. 1, ports 112 and 114 are interconnected by a fluid conduit 115 in which is disposed a reversible pump 117. Pump 117 is driven by shaft 18 from engine 10, as diagrammatically indicated at 120 in FIG. 1. It can be seen that pump 117 can, by pumping fluid into port 112 and drawing fluid out from port 114, cause piston 68 to move to the right, as viewed in the drawings, thereby driving pistons 70 and 72 along with it, and by pumping fluid through port 114 and withdrawing fluid from port 112, can drive all three interconnected pistons in the opposite direction, i.e. to the left as viewed in the drawings.

Piston 70 divides cylinder 60 into two annular, variable volume chambers 116 and 118. Chamber 116 is bounded by piston 70, partition wall 64, piston rod 74, and housing member 50. Chamber 118 is bounded by piston 70, partition wall 66, housing member 50 and sleeve 84, and thus has a much smaller transverse cross-sectional area and a smaller maximum volume than chamber 116. Partition wall 64 has an angular port 120 extending radially into partition wall 64 and thence longitudinally to chamber 116. Port 120 has a check valve assembly 124 mounted therein and designed to permit flow into but not out from chamber 116, so that port 120 serves as an inlet for said chamber. The valve assembly 124 includes a sleeve 126 threaded into the longitudinally oriented leg of port 120 and defining a frustoconical valve seat 128 facing into chamber 116. A valve element 130 has a frustoconical face which opposes seat 128. Valve element 130 is carried by valve stem 132 slidably mounted in a spider 134 on sleeve 126. A spring 136 biases valve element 130 into a closed position abutting seat 128. However, upon the application of sufficient pressure through port 120, the force of spring 136 may be overcome and the valve opened to permit fluid to flow into chamber 116.

Partition wall 64 has a second angular port 122 therein which serves as an outlet for chamber 116. Port 122 is provided with a check valve assembly 138 similar to assembly 124 except that the orientations of the valve seat and valve element are reversed. Specifically, assembly 138 includes a sleeve 140 defining a frustoconical seat 142 facing outwardly with respect to chamber 116. The valve element 144 carried by the valve stem 146 has a frustoconical surface opposing seat 142 and biased thereagainst by a spring 148. Valve stem 146 is slidably mounted in a spider 150 on sleeve 140. It can be seen that check valve assmebly 138 will permit fluid to flow outwardly from chamber 116, but will not permit reverse flow into the chamber 116 through port 122.

Housing member 50 is further provided with a pair of radial ports 152 and 154 communicating with chamber 118 adjacent partition wall 66. Ports 152 and 154 serve as an inlet and outlet respectively for chamber 118. Accordingly either the port 152 per se or a conduit associated therewith is provided with a check valve assembly, diagramatically indicated at 156 in FIG. 1, which will only permit flow into chamber 118 through port 152, while port 154 has associated therewith an oppositely directed check valve assembly 158, permitting only egress of fluid from chamber 118. The check valve assemblies 156 and 158 may be more or less conventional, and in particular, may be similar to assemblies 124 and 138 described above.

Piston 72 divides cylinder 62 into a pair of variable volume chambers 160 and 162. Chamber 160 is bounded by piston 72, end wall 56, and housing member 50, while chamber 162 is bounded by piston 72, partition wall 66, housing member 50, and sleeve 84. Thus chamber 162 has a much smaller transverse cross-sectional area and a smaller maximum volume than chamber 160. End wall 56 is provided with a pair of ports 164 and 166 which serve as an inlet and an outlet respectively for chamber 160. Inlet port 164 is provided which a check valve assembly 168 permitting fluid flow only into chamber 160, and then, only in the presence of a sufficient pressure. More specifically, valve assembly 168 is substantially identical to assembly 124 described above. Likewise, outlet port 166 is provided with a check valve assembly 172, substantially identical to assembly 138, for permitting flow only outwardly from chamber 160. Housing member 50 has a pair of radial ports 174 and 176 which serve as the inlet and outlet respectively for chamber 162. Inlet port 174 has associated therewith a check valve assembly 178 substantially identical to valve assembly 156, while outlet port 176 has a check valve assembly 180 substantially identical to assembly 158.

Referring again to FIG. 1, it can be seen that the outlet conduit 40 from vessel 30 has branches **40*a* and 40*b* which communicate respectively with inlet port 120 for chamber 116 and inlet port 164 for chamber 160. The outlet port 122 for chamber 116 is connected by a conduit 182 to the inlet port 152 for chamber 118. Conduit 182 has a cooling means 184 disposed therein. Similarly, outlet port 166 for chamber 160 is connected to inlet port 174 for chamber 162 by a conduit 186 having a cooler 188 therein. Finally, the outlet ports 154 and 176 for chambers 118 and 162 respectively have connected thereto outlet conduits 190 and 192 leading to a cooler 194, which in turn is connected to a collection vessel 196. Vessel 196 has an outlet conduit 198 containing a valve 200** by which gas can be selectively withdrawn and transferred to a desired service site.

Figure 3:
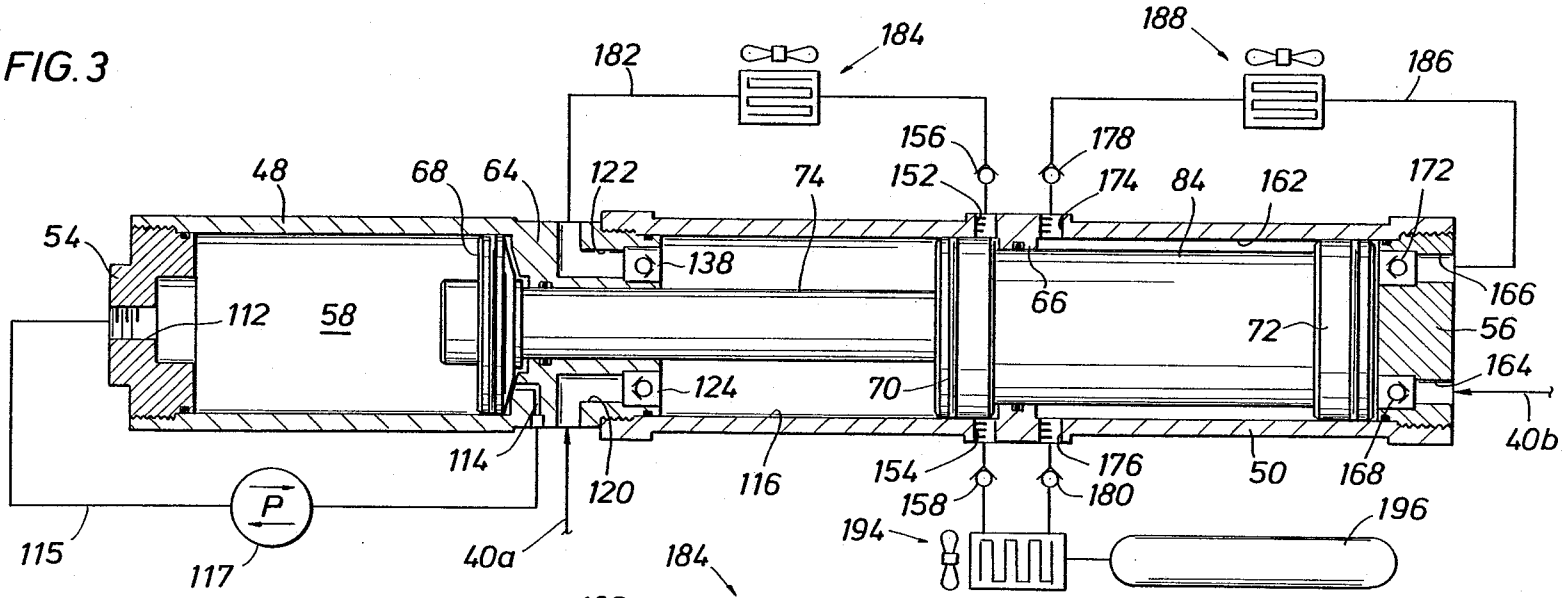
FIG. 3 is a simplified view of the compressor of FIGS. 2A and 2B, and related apparatus, shown in a first position.
Figure 4:
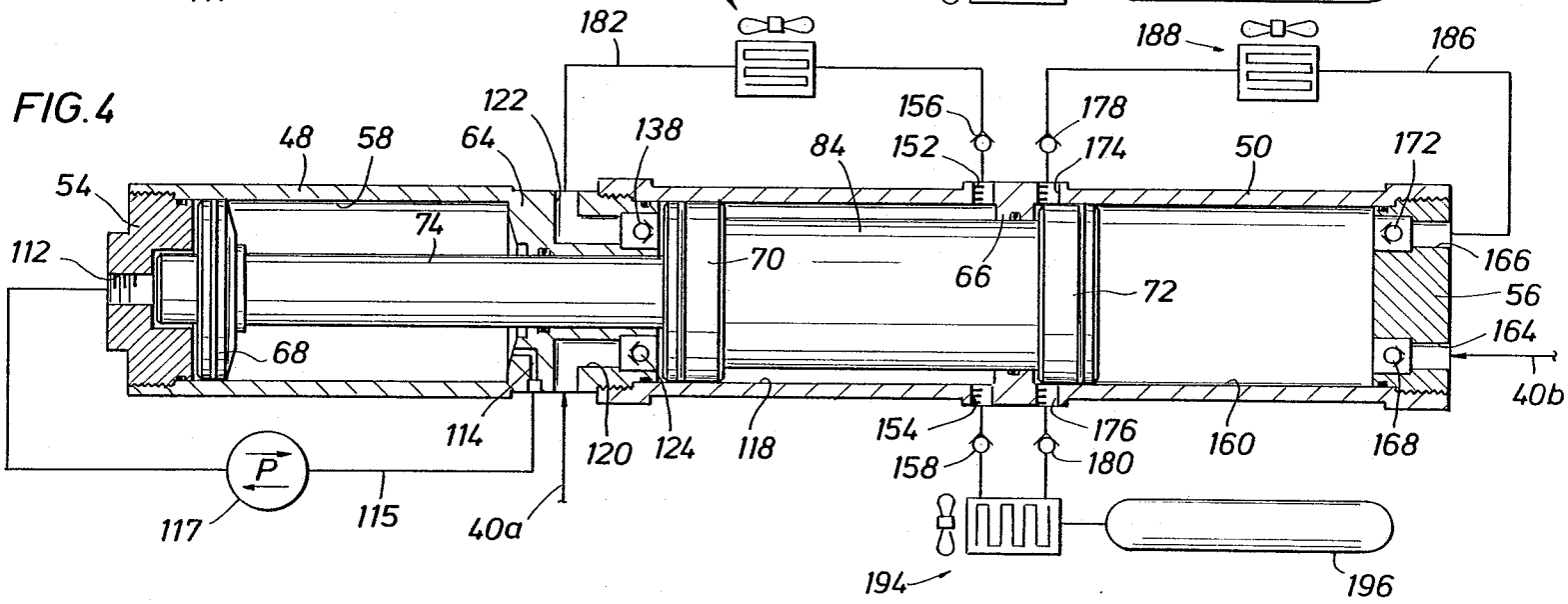
FIG. 4 is a view similar to that of FIG. 3, but showing the apparatus in a second position.

Referring now to FIGS. 3 and 4, the operation of compressor 44 as incorporated into the system of FIG. 1 will be described in greater detail. FIG. 3 shows the compressor in what will be, for purposes of the present discussion, a starting position. Pump 117 would have been operating in a direction to drive hydraulic fluid into cylinder 58 through port 112, and withdraw fluid through port 114. As shown in the FIG. 3, each of the three pistons, 68, 70 and 72 is at the far right hand end of its stroke. It can be seen that, with piston 70 located at the far right of cylinder 60, chamber 118 of that cylinder has been reduced to negligible volume while chamber 116 has been expanded to its maximum volume. To put it another way, the volume of the sum of chambers 116 and 118 has been maximized. During such expansion of chamber 116, pressurized gas from line **40*a* will have forced open check valve assembly 124 and entered chamber 116. The position of piston 72 has similarly reduced the volume of chamber 160 to a negligible value while expanding the volume of chamber 162** to its maximum.

From the starting position shown in FIG. 3, pump 117 will be reversed, preferrably automatically in a manner well known in the art, to begin pumping fluid inwardly through port 114 and withdrawing fluid from port 112 so as to drive 68 from right to left, carrying pistons 70 and 72 with it. As piston 70 moves from right to left, it reduces the volume of chamber 116 while expanding the volume of chamber 118. However, due to the difference in the transverse cross-sectional areas of chambers 116 and 118 as subdescribed above, the maximum volume of chamber 118 is substantially less than the maximum volume of chamber 116 so that the volume of the sum of the chambers is decreased.

During such right to left movement of piston 70, the pressure of the gas in chamber 116 will close valve assembly 124 but open valve assembly 138 so that the gas will flow outwardly through port 122, through conduit 182, into chamber 118.

As piston 70 moves from right to left, reducing the volume of chamber 116, it will further compress the gas therein before valve assembly 138 opens. Then, as the gas is driven into the smaller chamber 118, it is further compressed. It can be appreciated that the gas pressure sufficient to open valve assembly 138 will likewise be adequate to open valve assembly 156, permitting gas to enter chamber 118. Also, it should be noted that, as the partially compressed gas passes through conduit 182, its temperature is lowered by cooler 184.

During the aforementioned movement of piston 70, piston 72 will likewise be moving from right to left reducing the volume of chamber 162 and increasing the volume of chamber 160. Accordingly, during the right to left stroke, chamber 160 will be filled with gas from conduit 40b, the pressure of such gas and/or the vacuum drawn by piston 72 being adequate to open valve assembly 168 and permit said gas to flow through inlet port 164.

FIG. 4 shows the compressor after the three pistons 68, 70 and 72 have reached the far left hand ends of their strokes. At this point in the operation, pump 117 would again be reversed to begin driving piston 68 from left to right. As piston 70 moves from left to right along with driving piston 68, it will begin to decrease the volume of chamber 118 and increase the volume of chamber 116. Thus the gas within chamber 118 will be further compressed until it reaches a pressure sufficient to overcome the back pressure at 190, 196 and open valve assembly 158 so that said gas, at that point fully compressed, will pass through cooler 194 and into receiver 196. At the same time, chamber 116 will begin refilling with partially compressed gas from the diesel engine through conduit 40a. Simultaneously, piston 72 will be decreasing the volume of chamber 160 to compress the gas therein, opening valve assemblies 172 and 178 and driving such gas through conduit 186, cooler 188, and into chamber 162. When the apparatus again returns to the position of FIG. 3, pump 117 will once more be reversed, and the right to left movement of piston 72 will further compress the gas in chamber 162, opening valve assembly 180, and driving the compressed gas through cooler 194 and into receiver 196, while piston 70 will be once again be compressing gas in its chamber 116 and driving such partially compressed gas into the expanding chamber 118.

In addition to the various coolers 184, 188 and 194, housing members 48 and 50 may be provided with external fins 202 to assist in dissipating the heat generated by the gas compression process described above. As previously mentioned, in a typical operation, choke 36 is preferrably adjusted to regulate the volume of the gas entering chambers 116 and 160 through conduits 40a and 40b up to the maximum allowed by regulator 32. The relative volumes of the compressor chambers are set so that, as the gas is forced from one of the larger chambers 116 or 160 to its respective smaller chamber 118 or 162, it is further compressed to approximately 2000 psi. Then, as the volume of each of the smaller chambers 118 or 162 is further reduced by the appropriate piston movement, the gas is even further compressed to at least about 10,000 psi.

The foregoing represents a preferred embodiment of the invention, and it will be appreciated that numerous modifications can be made within the spirit of the invention. For example, in the above embodiment, it was contemplated that all cylinders of the engine 10 would be fired, and that the gas extracted would be exhaust gas. However, it would be possible to supply fuel to only some of the cylinders and fire only those cylinders to drive the engine. The remaining cylinders could then serve as small compressors from which a "cleaner" compressed gas could be extracted. Accordingly, it is intended that the scope of the invention be limited only by the claims which follow.

I claim:

1. A gas recovery system comprising:

an internal combustion engine having at least one combustion chamber and a drive piston movable therein;

extraction outlet means adapted for extracting compressed exhaust gas from said combustion chamber independently of the movements of said drive piston and subsequent to firing in said combustion chamber;

collection vessel communicatively connected to said combustion chamber by said extraction outlet means;

and means for preventing extraction of said gas from said combustion chamber through said extraction outlet means during recharging and compression therein and further preventing extraction of the entirety of such exhaust gas through said extraction outlet means comprising means for maintaining said collection vessel under pressure, and check valve means in said extraction outlet means operative by pressure in said combustion chamber exceeding the pressure in said collection vessel to open and permit flow from said combustion chamber to said collection vessel and and by pressure in said collection vessel exceeding the pressure in said combustion chamber to close and prevent flow from said collection vessel to said combustion chamber.

2. The system of claim 1 wherein said combustion chamber is a cylinder, said extraction outlet means being connected to the head of said cylinder.

3. The system of claim 1 wherein said engine comprises multiple combustion chambers, and wherein said extraction outlet means is connected to a plurality of said combustion chambers in parallel.

4. The system of claim 1 wherein said engine is a diesel engine.

5. The system of claim 1 further comprising compressor means having intake means communicatively connected to said extraction outlet means.

6. The system of claim 5 wherein said engine is operatively connected to said compressor means.

7. The system of claim 6 further comprising pressure regulator means between said compressor intake and said collection vessel for maintaining pressure in said vessel.

8. The system of claim 7 further comprising adjustable choke means interposed between said regulator means and said compressor intake means.

9. The system of claim 6 further comprising first cooling means interposed between said extraction outlet means and said compressor means.

10. The system of claim 9 further comprising second cooling means connected to the outlet of said compressor means.

11. The system of claim 6 wherein said compressor comprises:

first and second spaced-apart compressor pistons interconnected for joint movement in parallel paths;

housing means defining a first cylinder surrounding said first compressor piston and having a pair of access ports opening into said first cylinder respectively on opposite sides of said compressor piston; and a second cylinder surrounding said second compressor piston, said second compressor piston dividing said second cylinder into first and second variable-volume chambers, said first chamber having an inlet and an outlet, said inlet comprising at least a part of said intake means;

valve means associated with said outlet of said first chamber and operative to permit gas flow outwardly from said first chamber;

valve means associated with said inlet of said first chamber and operative to permit gas flow inwardly into said first chamber; and means operably connected to said engine for propelling a working fluid into and out of said first cylinder via said access ports to reciprocate said first compressor piston.

12. The system of claim 11 wherein said means for propelling working fluid comprises a reversible pump.

13. The system of claim 11 wherein said compressor further comprises:

inner wall means carried by said second compressor piston and extending longitudinally therefrom opposite said first chamber, whereby said second chamber is an annular chamber defined between said inner wall means and said second cylinder;

said second chamber having an inlet and an outlet;

valve means associated with said outlet of said second chamber and operative to permit gas flow outwardly from said second chamber;

valve means associated with said inlet of said second chamber and operative to permit gas flow inwardly into said second chamber;

and means communicatively connecting said outlet of said first chamber with said inlet of said second chamber.

14. The system of claim 13 wherein each of said valve means of said compressor comprises a check valve.

15. The system of claim 13 wherein said first and second compressor pistons are coaxially aligned and interconnected by a piston rod, said first and second cylinders being divided from each other by a first annular partition wall on said housing means slidably surrounding said piston rod; said first chamber being an annular chamber defined between said piston rod and said second cylinder, and the diameter of said piston rod being substantially less than the outer diameter of said inner wall means.

16. The system of claim 15 further comprising cooling means associated with said means interconnecting said outlet of said first chamber with said inlet of said second chamber, and further cooling means associated with said means interconnecting said outlet of said third chamber with said inlet of said fourth chamber.

17. The system of claim 16 wherein said second and third cylinders have external heat dissipation formations.

18. A method of providing compressed gas from an internal combustion engine having a combustion chamber and a drive piston movable therein, comprising the steps of:

communicating an extraction outlet means with said combustion chamber independently of the movements of said drive piston;

communicating a collection vessel with said extraction outlet means;

maintaining the pressure within said collection vessel at a value sufficient to prevent extraction of gas through said extraction outlet during recharging and compression in said combustion chamber and also prevent extraction of the entirety of the exhaust gas produced by a firing of said combustion chamber through said extraction outlet means;

repeatedly firing said combustion chamber to operate said engine;

extracting only a portion of the compressed exhaust gas from the combustion chamber through said extraction outlet means subsequent to each firing and prior to the next recharging of said chamber whenever the pressure in said combustion chamber exceeds the pressure in said collection vessel and without throttling of said extraction outlet means.

19. The method of claim 18 comprising utilizing a diesel engine as said internal combustion engine.

20. The method of claim 18 including so extracting gas from a plurality of combustion chambers of said engine.

21. The method of claim 18 wherein said combustion chamber is a cylinder, and said gas is extracted through the head of said cylinder.

22. The method of claim 18 wherein the pressure in said vessel is maintained at approximately 750 to 500 psi.

23. The method of claim 22 comprising utilizing a diesel engine as said internal combustion engine.

24. The method of claim 18 comprising further compressing said gas subsequent to extraction from said combustion chamber.

25. The method of claim 24 wherein said further compression is performed by a compressor operated by said internal combustion engine.

26. The method of claim 25 wherein said further compression is performed with a linearly hydraulically driven gas compressor operated by a reversible pump driven by said engine.

27. The method of claim 25 wherein said further compression is performed in two stages.

28. The method of claim 25 comprising cooling said gas subsequent to such extraction from said combustion chamber and prior to such further compression.

29. The method of claim 28 wherein said extraction and cooling is performed so as to provide said gas to said compressor at a pressure between about 500 psi and about 750 psi.

30. The method of claim 29 comprising regulating the pressure of said gas prior to such further compression so that said gas is provided to said compressor at a generally uniform pressure.

31. The method of claim 30 comprising further cooling said gas subsequent to said further compression.

32. The method of claim 31 wherein said further compression and further cooling is performed so as to provide product gas at at least about 10,000 psi.

33. A compressor comprising:

first, second and third spaced apart pistons interconnected for joint movement in coaxial paths, said first and second pistons being interconnected by a piston rod, with inner wall means being carried by said second piston and extending longitudinally therefrom opposite said piston rod, and the diameter of said piston rod being substantially less than the outer diameter of said inner wall means;

housing means defining a first cylinder surrounding said first piston and having a pair of access ports opening into said first cylinder respectively on opposite sides of said piston;

a second cylinder surrounding said second piston, said second piston dividing said second cylinder into first and second variable volume chambers, said first and second chambers each having an inlet and an outlet respectively for admitting gas to and discharging gas from said chamber;

and a third cylinder surrounding said third piston, said third piston dividing said third cylinder into third and fourth variable volume chambers, each of said third and fourth chambers having an inlet and an outlet respectively for admitting gas to and discharging gas from said chamber;

said first and second cylinders being divided from each other by a first annular partition wall on said housing means slidably surrounding said piston rod;

said first chamber being an annular chamber defined between said piston rod and said second cylinder;

and said second chamber being an annular chamber defined between said inner wall means and said second cylinder;

each of said outlets of said first, second, third and fourth chambers having a respective valve means associated therewith and operative to permit gas flow outwardly from said chamber;

each of said inlets of said first, second, third and fourth chambers having a respective valve means associated therewith and operative to permit gas flow inwardly into said chamber;

means communicatively connecting said outlet of said first chamber with said inlet of said second chamber;

means communicatively connecting said outlet of said third chamber with said inlet of said fourth chamber;

and means for propelling a working fluid into and out of said first cylinder via said access ports to reciprocate said first piston.

34. The compressor of claim 33 wherein said valve means are check valve means.

35. The compressor of claim 33 wherein said third piston is disposed on the opposite side of said second piston from said first piston and coaxially aligned therewith, said inner wall means extending from said second piston to said third piston, said fourth chamber being defined adjacent said second chamber between said third cylinder and said inner wall means, and said second and third cylinders being divided from each other by a second annular partition wall on said housing slidably surrounding said inner wall means.

36. The compressor of claim 33 wherein said means for propelling working fluid comprises a reversible pump.

37. The compressor of claim 33 further comprising cooling means associated with said means interconnecting said outlet of said first chamber with said inlet of said second chamber, and further cooling means associated with said means interconnecting said outlet of said third chamber with said inlet of said fourth chamber.

38. The compressor of claim 37 wherein said second and third cylinders have external heat dissipation formations.

39. A gas recovery system comprising:

an internal combustion engine having at least one combustion chamber and a drive piston movable therein;

extraction outlet means adapted for extracting compressed exhaust gas from said combustion chamber independently of the movements of said drive piston and subsequent to firing in said combustion chamber;

means for preventing extraction of gas from said combustion chamber through said extraction outlet means during recharging and compression therein and further preventing extraction of the entirety of such exhaust gas through said extraction outlet means;

and compressor means comprising first, second and third spaced apart compressor pistons interconnected for joint movement in coaxial paths, said first and second compressor pistons being interconnected by a piston rod, with inner wall means being carried by said second compressor piston and extending longitudinally therefrom opposite said piston rod, and the diameter of said piston rod being substantially less than the outer diameter of said inner wall means;

housing means defining a first cylinder surrounding said first compressor piston and having a pair of access ports opening into said first cylinder respectively on opposite sides of said first compressor piston;

a second cylinder surrounding said second compressor piston, said second compressor piston dividing said second cylinder into first and second variable volume chambers, said first and second chambers each having an inlet and an outlet respectively for admitting gas to and discharging gas from said chamber;

and a third cylinder surrounding said third compressor piston, said third compressor piston dividing said third cylinder into third and fourth variable volume chambers, each of said third and fourth chambers having an inlet and an outlet respectively for admitting gas to and discharging gas from said chamber;

said first and second cylinders being divided from each other by a first annular partition wall on said housing means slidably surrounding said piston rod;

said first chamber being an annular chamber defined between said piston rod and said second cylinder;

and said second chamber being an annular chamber defined between said inner wall means and said second cylinder;

each of said outlets of said first, second, third and fourth chambers having a respective valve means associated therewith and operative to permit gas flow outwardly from said chamber;

means communicatively connecting said extraction outlet means with said inlets of said first and third chambers;

means communicatively connecting said outlet of said first chamber with said inlet of said second chamber;

means communicatively connecting said outlet of said third chamber with said inlet of said fourth chamber;

and means operably connected to said engine for propelling a working fluid into and out of said first cylinder via said access ports to reciprocate said first compressor piston.

40. The system of claim 39 wherein each of said valve means of said compressor comprises a check valve.

41. The system of claim 39 wherein said third compressor piston is disposed on the opposite side of said second compressor piston from said first compressor piston and coaxially aligned therewith, said inner wall means extending from said second compressor piston to said third compressor piston, said fourth chamber being defined adjacent said second chamber between said third cylinder and said inner wall means, and said second and third cylinders being divided from each other by a second annular partition wall on said housing slidably surrounding said inner wall means.

* * * * *